US009156281B2

(12) United States Patent
Dubuit et al.

(10) Patent No.: US 9,156,281 B2
(45) Date of Patent: Oct. 13, 2015

(54) INKJET PRINTING MACHINE

(75) Inventors: Jean-Louis Dubuit, Paris (FR); Francois Dumenil, Chaumes en Brie (FR); Fabien Gavet, Cormeilles en Parisis (FR)

(73) Assignee: Machines Dubuit, Noisy le Grand (FR)

( * ) Notice: Subject to any disclaimer, the term of this patent is extended or adjusted under 35 U.S.C. 154(b) by 326 days.

(21) Appl. No.: 13/279,934

(22) Filed: Oct. 24, 2011

(65) Prior Publication Data

US 2012/0098914 A1 Apr. 26, 2012

(30) Foreign Application Priority Data

Oct. 25, 2010 (FR) ..... 10 58717

(51) Int. Cl.

| | |
|---|---|
| ***B41J 2/01*** | (2006.01) |
| ***B41J 3/00*** | (2006.01) |
| ***B41J 23/00*** | (2006.01) |
| ***B41J 3/407*** | (2006.01) |
| ***B41J 3/54*** | (2006.01) |
| *B41J 3/28* | (2006.01) |

(52) U.S. Cl.

CPC ..... *B41J 3/4073* (2013.01); *B41J 3/543* (2013.01); *B41J 3/283* (2013.01); *B41J 3/286* (2013.01)

(58) Field of Classification Search

CPC ..... B41J 3/445; B41J 2/01; B41J 2/0458; B41J 2/04541; B41J 2/175; B41J 2/17596; B41J 19/202; B41J 2/1752; B41J 2/17566; B41J 2/17513; B41J 25/308; B41J 25/3082; B41J 2/04563; B41J 11/42; B41J 29/393; B41J 2/145; B41J 2/005; B41J 2/155; B41J 2202/20; B41J 2/2114; B41J 11/0015; B41J 11/002; B41J 11/007; B41J 11/06; G01D 15/18

USPC ..... 347/2, 37, 5, 6, 7, 8, 9, 12, 14, 16, 38, 347/39, 40, 101, 102, 104

See application file for complete search history.

(56) References Cited

U.S. PATENT DOCUMENTS

| | | | | | |
|---|---|---|---|---|---|
| 3,548,745 | A | * | 12/1970 | Sirvet Enn et al. | 101/40 |
| 3,613,571 | A | * | 10/1971 | Russell et al. | 101/40 |
| 3,645,201 | A | * | 2/1972 | Jackson | 101/40.1 |
| 3,822,639 | A | * | 7/1974 | Szpitalak | 101/40 |

(Continued)

FOREIGN PATENT DOCUMENTS

| | | |
|---|---|---|
| CH | 695 555 | 6/2006 |
| DE | 10 2009 014321 | 9/2010 |

(Continued)

*Primary Examiner* — Julian Huffman
*Assistant Examiner* — Leonard S Liang
(74) *Attorney, Agent, or Firm* — Davidson, Davidson & Kappel, LLC

(57) ABSTRACT

A printing machine is providing including a transporter for transporting objects to be printed, a printing station including at least four printing units arranged to project ink on the objects to be printed, a transfer device for transferring an object to be printed from the transporter to the printing station and from the printing station to the transporter. The printing station includes a single mandrel corresponding to the maintenance of an object to be printed, the corresponding mandrel being rotatably movable around its axis so that the printing units project ink onto the object maintained by the corresponding mandrel, the printing station being arranged to print only the objects maintained by the corresponding mandrel.

19 Claims, 9 Drawing Sheets

(56) References Cited

U.S. PATENT DOCUMENTS

| | | | | |
|---|---|---|---|---|
| 3,889,630 | A * | 6/1975 | Szpitalak | 118/46 |
| 3,934,500 | A * | 1/1976 | Jackson | 101/40.1 |
| 3,955,496 | A * | 5/1976 | Urban | 101/40 |
| 3,960,073 | A * | 6/1976 | Rush | 101/40 |
| 4,037,530 | A * | 7/1977 | Sirvet | 101/40 |
| 4,267,771 | A * | 5/1981 | Stirbis | 101/40 |
| 4,337,719 | A * | 7/1982 | vander Griendt et al. | 118/46 |
| 4,397,710 | A * | 8/1983 | Gaylord | 156/475 |
| 4,498,387 | A * | 2/1985 | Stirbis | 101/40 |
| 4,773,326 | A * | 9/1988 | Hudec | 101/40 |
| 4,892,184 | A * | 1/1990 | vander Griendt et al. | 198/476.1 |
| 5,031,527 | A * | 7/1991 | Eppinger | 101/115 |
| 5,144,330 | A * | 9/1992 | Bennett | 347/2 |
| 5,265,532 | A * | 11/1993 | DiDonato et al. | 101/40 |
| 5,361,694 | A * | 11/1994 | Dubuit | 101/115 |
| 5,444,469 | A * | 8/1995 | Cowger | 347/14 |
| 5,602,624 | A * | 2/1997 | Coburn et al. | 347/2 |
| 5,740,727 | A * | 4/1998 | Shriver | 101/40 |
| 5,970,874 | A * | 10/1999 | Bill | 101/488 |
| 6,135,654 | A * | 10/2000 | Jennel | 400/61 |
| 6,154,232 | A * | 11/2000 | Hickman et al. | 347/40 |
| 6,769,357 | B1 * | 8/2004 | Finan | 101/38.1 |
| 6,811,648 | B1 * | 11/2004 | Dominico | 156/277 |
| 7,060,969 | B2 * | 6/2006 | Uchiyama et al. | 250/231.16 |
| 8,070,244 | B2 * | 12/2011 | Dumenil | 347/2 |
| 8,365,658 | B2 * | 2/2013 | Ouchi | 101/32 |
| 8,800,438 | B2 * | 8/2014 | Beck | 101/35 |
| 8,800,439 | B2 * | 8/2014 | Clark et al. | 101/41 |
| 8,888,240 | B1 * | 11/2014 | Kasiske et al. | 347/42 |
| 2002/0108520 | A1 * | 8/2002 | Kolbe et al. | 101/479 |
| 2002/0134257 | A1 * | 9/2002 | Stephenson | 101/35 |
| 2004/0085425 | A1 * | 5/2004 | Lewis | 347/104 |
| 2005/0046648 | A1 * | 3/2005 | Dumenil | 347/2 |
| 2005/0066826 | A1 * | 3/2005 | Dubuit et al. | 101/126 |
| 2005/0178279 | A1 * | 8/2005 | Valls | 101/38.1 |
| 2005/0284313 | A1 * | 12/2005 | Louviere et al. | 101/35 |
| 2007/0089619 | A1 * | 4/2007 | Finan | 101/38.1 |
| 2008/0264276 | A1 | 10/2008 | Dumenil | 101/40 |
| 2008/0282913 | A1 * | 11/2008 | Noll et al. | 101/39 |
| 2010/0031834 | A1 * | 2/2010 | Morgavi et al. | 101/38.1 |
| 2010/0039487 | A1 * | 2/2010 | Sawatsky | 347/102 |
| 2010/0091054 | A1 * | 4/2010 | Vesanto et al. | 347/9 |
| 2010/0192517 | A1 * | 8/2010 | Schach | 53/411 |
| 2010/0295885 | A1 * | 11/2010 | LaCaze | 347/8 |

FOREIGN PATENT DOCUMENTS

| | | | |
|---|---|---|---|
| EP | 620117 | A2 * | 10/1994 |
| EP | 1225053 | A2 * | 7/2002 |
| EP | 1 918 100 | | 5/2008 |
| WO | WO 2004/009360 | | 1/2004 |

* cited by examiner

INKJET PRINTING MACHINE

This claims the benefit of French Patent Application FR 10 587 17, filed Oct. 25, 2010 and hereby incorporated by reference herein.

BACKGROUND

The present invention relates to a machine for printing objects substantially having shapes of revolution of the type comprising:

means for transporting objects to be printed between at least one station for loading objects on said transport means and a station for unloading said objects from said transport means, at least one printing station arranged between the loading station and the unloading station, said printing station comprising at least four printing units arranged to project ink on the objects to be printed so as to print said objects, each printing unit projecting ink of a different color so as to make up a four-color process, means for transferring an object to be printed from the transport means to the printing station and from the printing station to the transport means.

Document EP-1 918 100 describes a printing machine in which a plurality of mandrels supporting objects to be printed are provided on a rotary plate to pass in front of a series of processing stations for the object to be printed, including a printing station. Each mandrel can move between a transfer position, in which the mandrel is moved with the rotary plate from one processing station to the other, and a printing position, in which the mandrel is positioned opposite printing units of the printing station and is rotated around its axis to expose a printing area of the object to be printed to the different ink jets coming from the printing units.

In the printing position, a handle for rotating the mandrel engages with a driving guide rotated by a drive motor so as to rotate the mandrel around its axis. Due to the mechanical and machining allowances of the mandrels and said driving means, it is very difficult to ensure identical positioning and a constant speed of rotation for all of the mandrels that pass in front of the printing station. Thus, from one mandrel to another, the positions of the objects supported by said mandrels and their rotational speed profile can be substantially different. Each printing unit comprises a plurality of inkjet nozzles arranged in two lines parallel to the axis of rotation of the mandrel and spaced apart by a small distance, for example 0.075 mm, in a direction substantially perpendicular to the axis of rotation of the mandrel. The two lines of nozzles must project ink onto a same line of the printing zone of the object to be printed, i.e. the inkjets of the two lines must converge on the surface of the object to be printed.

SUMMARY OF THE INVENTION

However, since it is not possible to position each mandrel precisely relative to the printing units due to the mechanical and machining allowances, the inkjets do not converge on the surface of the objects, which results in a deteriorated quality of the printing on the objects. This problem is also increased if the rotational speed profiles vary from one mandrel to the other, the printing units being controlled to project the ink as a function of said speeds of rotation. Thus, to have satisfactory printing, it would be necessary to refine the adjustment of the position of each mandrel and its speed of rotation so that they are strictly identical from one mandrel to another, which is impossible to do in an automated manner and is completely incompatible with large-scale production rhythms.

Furthermore, such a printer does not make it possible to easily increase the number of printing units around a mandrel, to increase the printing rhythms. In fact, it is necessary to provide a space to allow the mandrel to move between its printing position and its transfer position, which limits the choices in the positioning of the printing units, the units having to be distributed while covering at most an angle of 180°, i.e. over a semi-circle, to allow the mandrel to go from its transfer position to its printing position.

It is an object of the present invention to provide a printing machine making it possible to achieve great precision in the printing of objects while being easy to implement and making it possible to increase the printing rhythms of the objects.

The present invention provides a printer of the aforementioned type, in which the printing station comprises a single mandrel corresponding to the maintenance of an object to be printed, said corresponding mandrel being rotatably movable around its axis so that the printing units project ink onto the object maintained by said corresponding mandrel, the printing station being arranged to print only the objects maintained by said corresponding mandrel.

Since the printing station comprises a single mandrel and only prints the objects supported by said mandrel, it is possible to achieve great precision in the positioning of the mandrel relative to the printing units and to perfectly know the rotational speed profile of the mandrel and obtain a constant speed of rotation. Thus, it is not necessary to perform a new adjustment for each object to be printed, the positioning of the objects being strictly identical from one object to another supported by that same single mandrel corresponding to the printing station. High-quality printing is thus obtained and it is possible to increase the printing rhythms.

According to other features of the printing machine:

the axis of rotation of the mandrel is stationary relative to the printing station, the printing units of the printing station being arranged on an arc of circle centered on the axis of rotation of the corresponding mandrel;

each printing unit can be moved in a substantially radial direction relative to the axis of rotation of the mandrel so as to make it possible to move the printing unit away from or closer to said axis of rotation as a function of the diameter of the object to be printed;

the printing machine comprises a calibration ring comprising a central opening coaxial to the axis of rotation of the mandrel, said ring being arranged between the transfer means and the printing unit so that an object to be printed passes through the central opening before being printed by the printing station;

the diameter of the central opening is larger than the diameter of the mandrel and smaller than the sum of the outer diameter of the object to be printed and arranged so that there is a space of at least 0.1 mm between an object passed through the central opening of the ring and the nozzles of the printing unit;

the ring can be moved and is arranged to actuate a contactor, arranged to stop the transfer means when it is actuated, if an object to be printed having a diameter larger than the diameter of the central opening, taken by the transfer means, moves said ring;

the mandrel is translationally mobile along its axis between a printing position, in which the free end portion of the mandrel is located opposite the printing units, and a loading position, in which the central opening of the ring surrounds the free end portion of the mandrel;

the printing station comprises at least one additional printing unit in addition to the four printing units, said four units and said additional unit being distributed on a same arc of circle centered on the axis of rotation of the corresponding mandrel;

the printing station also comprises a surface drying unit for drying the ink projected on the object to be printed, said unit being arranged on the same arc of circle centered on the axis of rotation of the corresponding mandrel as the printing unit;

the mandrel is translationally mobile along its axis so as to make it possible to expose several areas of the maintained object to the inkjet from the printing unit;

the transfer means comprise at least one mobile arm supporting means for gripping an object to be printed, said arm and said gripping means being arranged to take an object on the transport means and to deposit said object on the mandrel and to take the printed object from said mandrel and deposit said printed object on the transport means;

the transport means comprise an endless conveyor, said conveyor comprising a plurality of fingers for receiving an object to be printed;

the printing machine comprises means for blocking the position of an object around a receiving finger opposite to the transfer means, said blocking means being mobile between a blocking position, in which said blocking means keep an object immobile around a receiving finger opposite to the transfer means, and a retracted position, in which the blocking means are moved away from the conveyor;

the blocking means comprise a translationally mobile blocking element, the blocking element comprising at least one blocking surface, said blocking means being arranged so that the blocking surface is in contact with an object supported by the receiving finger in the blocking position and so that the blocking surface is moved away from the conveyor in the retracted position, said blocking means also comprising means for suctioning the object supported by the receiving finger, said suction means being arranged to immobilize said object on the blocking surface in the blocking position;

the printing machine comprises a station for pretreating the surface of the objects to be printed, said station being arranged between the loading station and the printing station and being arranged to treat the surface of the objects to be printed on the transport means;

the printing machine comprises at least one station for drying the surface of the printed objects, said station being arranged between the printing station and the unloading station and being arranged to dry the surface of the printed objects;

the printing machine comprises at least two printing stations each comprising a corresponding single mandrel, said printing stations being arranged each to print only the objects maintained by their corresponding mandrel; and the endless conveyor is arranged to stop when a finger supporting an object to be printed is located opposite to corresponding transfer means to each printing station.

BRIEF DESCRIPTION OF THE DRAWINGS

Other aspects and advantages of the invention will appear upon reading the following description, provided as an example and done in reference to the appended drawings, in which.

DETAILED DESCRIPTION

Figure 1:
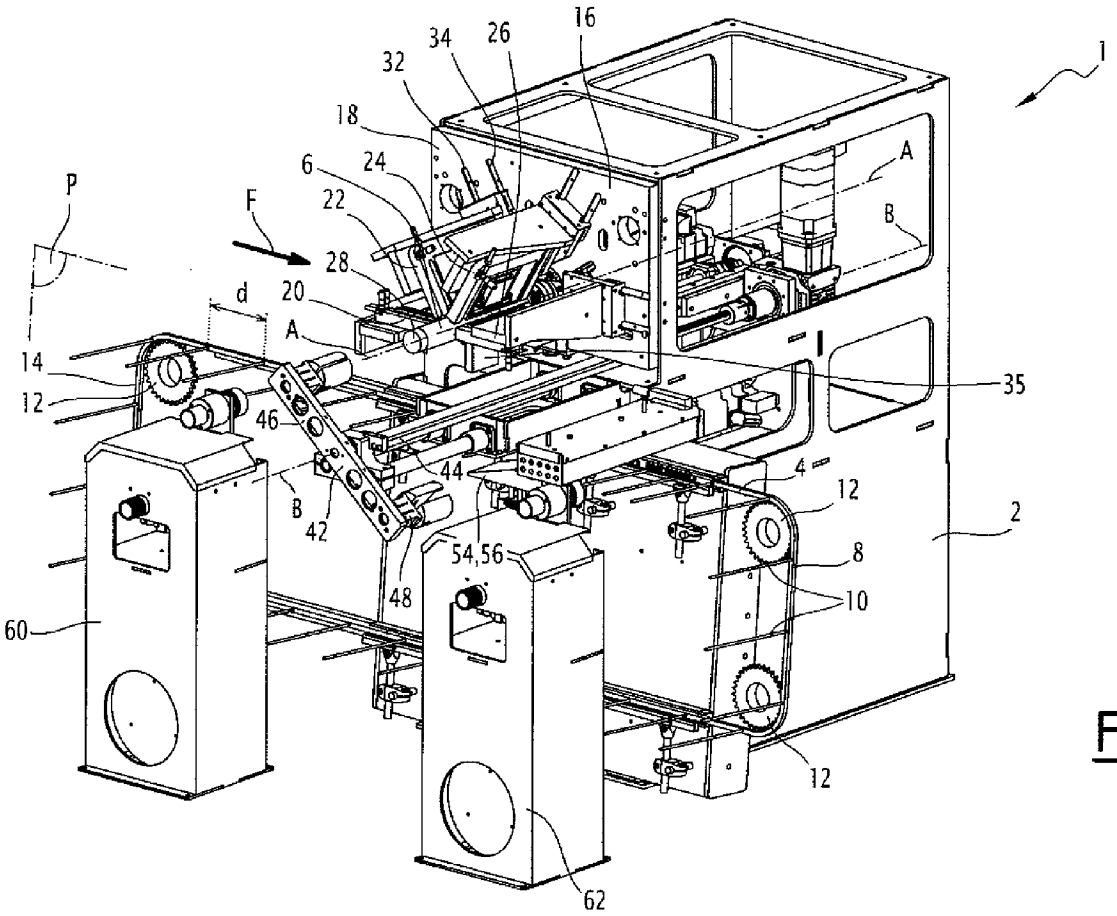
FIG. 1 is a diagrammatic perspective illustration of a printing machine according to one embodiment of the invention, the machine comprising a single printing station.
Figure 2:
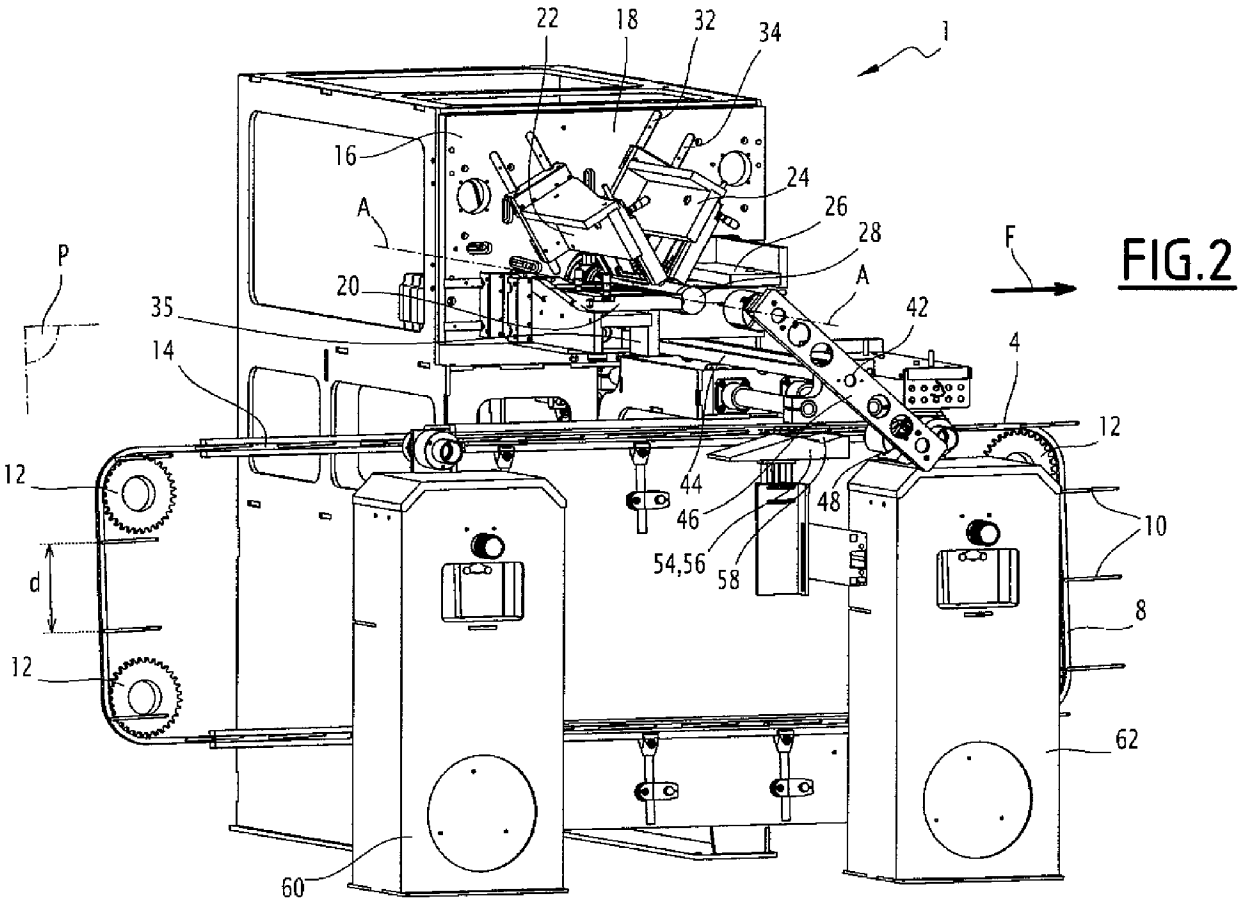
FIG. 2 is a diagrammatic perspective illustration of the printing machine of FIG. 1 in another orientation.

The printing machine 1 according to the invention is shown in FIGS. 1 and 2. It comprises a frame 2 supporting transport means 4 for objects 6 to be printed. The objects 6 to be printed substantially have shapes of revolution, such as substantially cylindrical tubes or containers.

Figure 3:
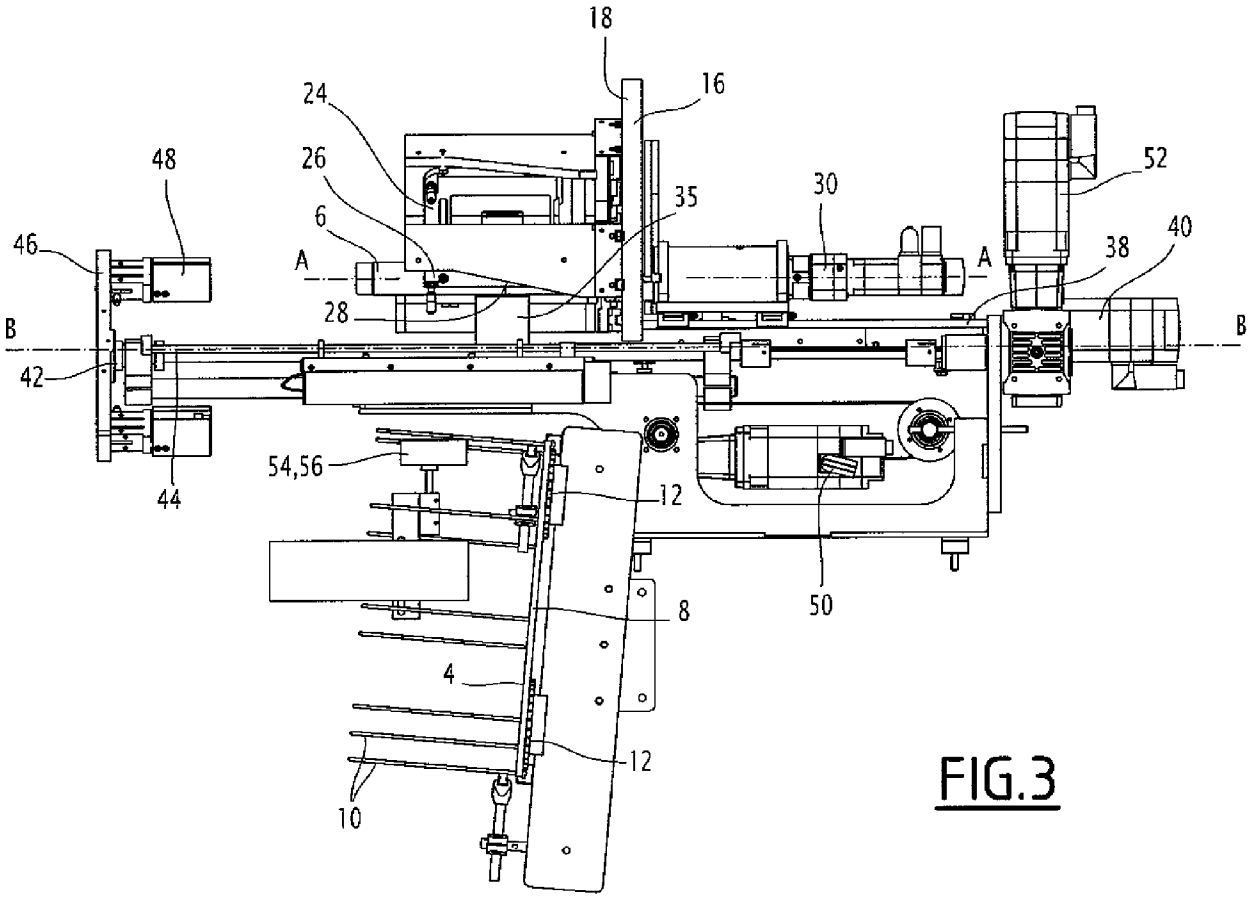
FIG. 3 is a diagrammatic side illustration of the printing machine of FIG. 1, FIGS. 4 and 5 are diagrammatic top illustrations of a mandrel supporting an object to be printed and a printing unit, the object being placed in two different positions.

The transport means 4 are formed by an endless conveyor 8, supporting a plurality of fingers 10 for receiving an object to be printed, separated from one another by a distance d defining the pitch of the transport means. The conveyor 8 is for example formed by a belt closed on itself, such as a transport chain, arranged around driving means 12, such as toothed wheels, arranged so that the conveyor has a substantially rectangular shape. The driving means 12 are rotatably mounted on the frame 2 and at least one of the driving means 12 is rotated by a motor so as to make the belt 8 circulate in a circulation plane P, in which the entire conveyor 8 extends, on the driving means 12. The branch 14 of the belt circulating on the upper driving means 12, called upper branch 14, is the part of the belt that supports the objects 6 to be printed and moves them between the different stations of the printing machine 1, as will be described later. The upper branch 14 extends substantially horizontally and moves in a substantially vertical plane. The circulation plane P of the conveyor 8 is inclined relative to the vertical plane in which the upper branch circulates, as shown in FIG. 3. Such an incline makes it possible to constantly subject the objects 6 supported by the fingers 10 to a force that presses them against the fingers 10 so as to ensure good maintenance of the objects 6 on the fingers. In the figures, arrow F shows the direction of circulation of the upper branch 14 of the conveyor 8.

The fingers 10 are formed by fine rods having a sufficient length to receive the objects 6 and retain them freely. The fingers 10 extend from the conveyor 8 in a direction substantially perpendicular to the circulation plane P of the conveyor 8 toward the outside of the frame 2.

The transport means 4 described above are for example known from document U.S. Pat. No. 7,540,232.

In a known manner, the objects 6 to be printed are arranged on the fingers 10 one after the other at a loading station (not shown) arranged upstream of the upper branch 14 relative to the direction of circulation F. Also in a known manner, the objects 6 to be printed are removed from the fingers 10 at an unloading station (not shown) arranged downstream of the upper branch 14 relative to the direction of circulation F. The loading and unloading of the objects can be done using all suitable means, known by those skilled in the art and not described in detail here.

The upper branch 14 circulates opposite at least one printing station 16 arranged between the loading station and the unloading station.

The printing station 16 comprises a platen 18 fastened on the frame 2 and extending substantially in the circulation plane of the upper branch 14, i.e. substantially vertically. According to the embodiment shown in the figures, the printing station comprises four printing units 20, 22, 24, 26 mounted next to one another on the platen 18 around a mandrel 28 mounted rotatably mobile on the frame 2, relative to the platen 18. The four printing units make it possible to print photographic images because each unit is supplied with ink of a different color, i.e. the three primary colors (yellow, cyan and magenta) and a black ink in order to make up a four-color process. These inks therefore make it possible to print any type of image on the objects 6.

The mandrel 28 is able to support the objects 6 to be printed and has an axis of revolution A-A around which the mandrel 28 is rotationally mobile, driven by a motor 30 (FIG. 3) whereof the drive shaft is directly engaged with the axis of the mandrel 28, i.e. the drive shaft of the motor 30 extends along axis A-A. The speed of rotation of the mandrel 28 is therefore constant and is easy to adjust since it is equal to the speed rotation of the drive shaft of the motor 30. The axis A-A of the mandrel 28, substantially perpendicular to the circulation plane of the upper branch 14 and therefore perpendicular to the platen 18, is stationary relative to the platen 18. In other words, the mandrel 28 is not translationally mobile in the vertical circulation plane of the upper branch 14 of the conveyor 8 and the axis of rotation A-A of the mandrel 28 is stationary relative to the printing station 16.

The printing units 20, 22, 24, 26 are inkjet devices comprising a plurality of nozzles arranged to project ink onto a printing area of the objects 6 to be printed in a known manner. Such printing units being known, they will not be described in detail here. One skilled in the art may for example refer to document EP-1 918 100.

The printing units 20, 22, 24, 26 are arranged on an arc of circle whereof the center is confused with axis A-A of the mandrel 28 so that the nozzles extend substantially parallel to axis A-A of the mandrel 28 and are situated opposite the area to be printed of the object 6 supported by the mandrel 28, for example at a distance substantially comprised between 1 mm and 3 mm from the area to be printed. The platen 18 is provided with one pair of positioning rails 32, 34 per printing unit, said rails extending radially around axis A-A of the mandrel 28 in order to make it possible to adjust the distance of the printing units 20, 22, 24, 26 relative to axis A-A. The printing units 20, 22, 24, 26 are each mounted on a pair of rails 32, 34, which makes it possible to adjust the position of the printing units 20, 22, 24, 26 as a function of the diameter of the objects 6 to be printed by moving the printing units on their respective rails 32, 34. The movement of the printing units 20, 22, 24, 26 on the rails 32, 34 can be done using a single motor connected to the units by suitable means.

According to the embodiment shown in the figures, the printing units 20, 22, 24, 26 are arranged over a 180° range around the object 6 to be printed. In that range, the printing units 20, 22, 24, 26 are distributed regularly so as to form a 45° angle relative to one another.

It is, however, understood that the four printing units could be distributed over a range greater than 180° or more than four printing units could be provided over a range greater than 180°. In fact, the axis of the mandrel 28 being stationary relative to the printing station, it is not necessary to provide clearance space making it possible to move the mandrel 28 in the vertical circulation plane of the upper branch 14. Thus, the printing station could be laid out so that printing or drying units surround the entire circumference of the mandrel 28. This for example makes it possible to increase the printing rhythm by increasing the number of printing units arranged around the mandrel 28.

According to one embodiment, the printing station 16 also comprises a surface drying unit 35 for drying the ink projected on the object 6 to be printed. This unit 35 is for example made up of one or more light-emitting diodes (LED) mounted on a support arranged on the same arc of circle as the printing units and positioned opposite to the printing area of the object 6 to be printed. The drying unit can freeze the printed ink on the object 6 fitted onto the mandrel 28.

One or two additional printing units can also be provided on the same arc of circle as the other printing units in order to varnish the printing area after printing thereof using one of the additional printing units and/or to print a white background (for example on a colored object 6) before printing the other colors making up the four-color process, using the other additional printing unit belonging to the printing units.

Figure 4:
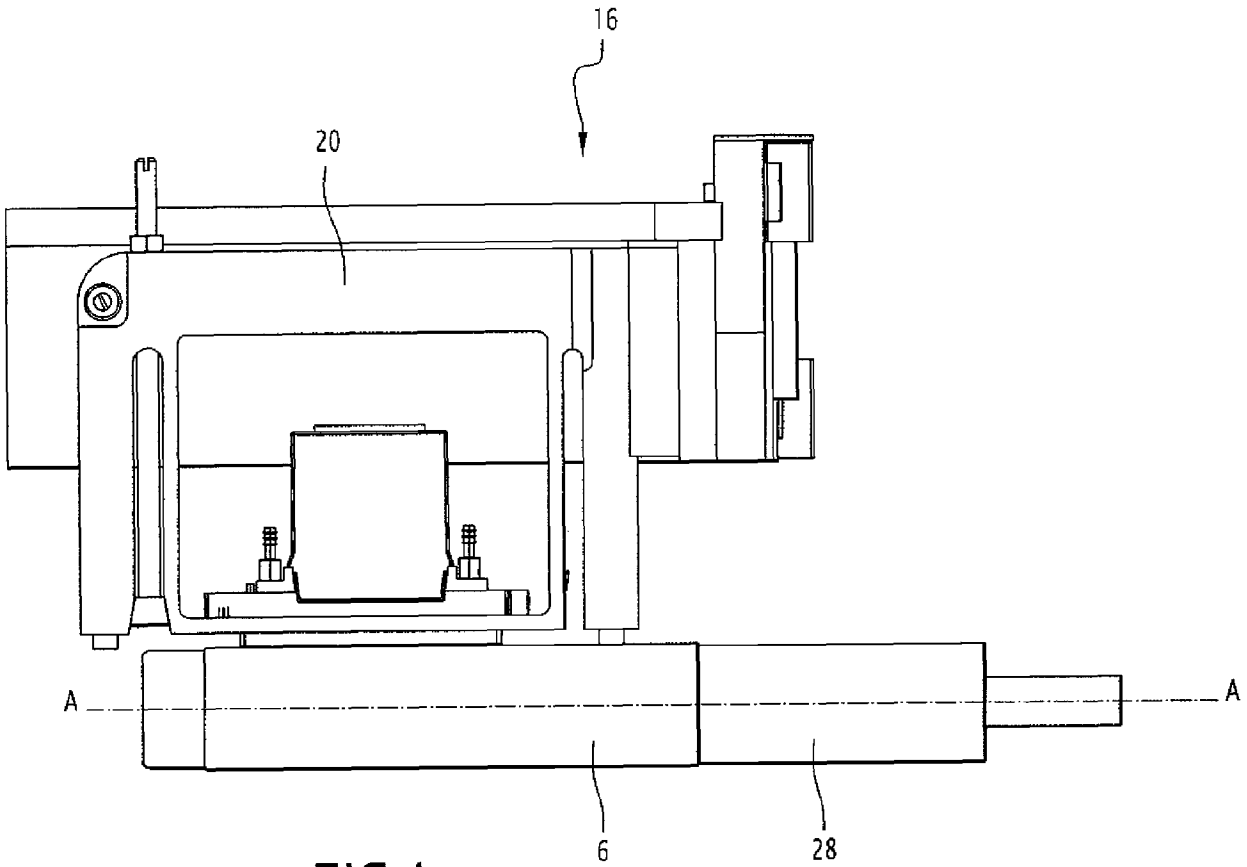
Figure 5:
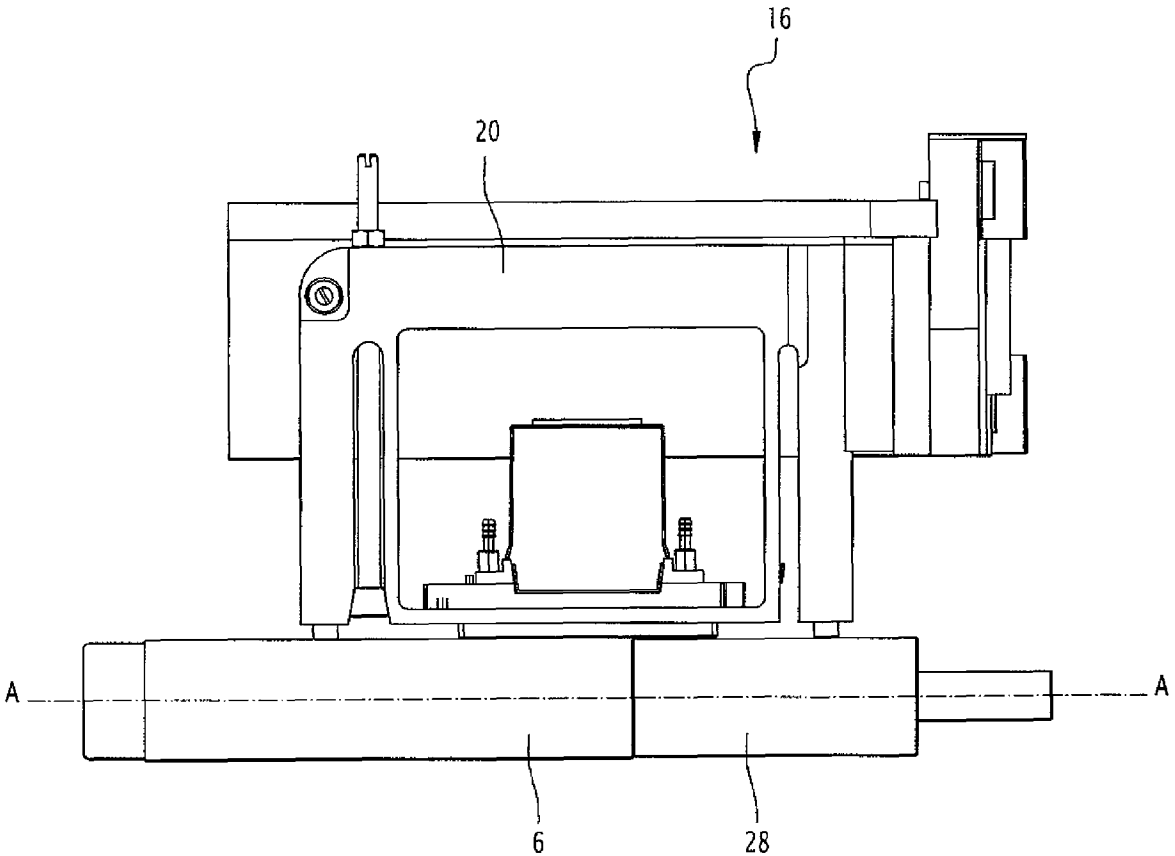

The mandrel 28 is also translationally mobile along its axis A-A in order to make it possible to expose a wider printing area, or several printing areas, to the printing units 20, 22, 24, 26, as shown in FIGS. 4 and 5. Since axis A-A of the mandrel 28 is stationary relative to the platen 18, it is particularly simple to make the mandrel 28 translationally mobile. To do that, the assembly formed by the mandrel 28 and its driving motor 30 is mounted on rails 38 (FIG. 3) extending substantially parallel to axis A-A and the translational movement is actuated by a motor 40 connected to the mandrel 28/motor 30 assembly by suitable means. Thus, objects 6 having a printing area with a height greater than the height of the printing units 20, 22, 24, 26 can be printed by translating the mandrel 28 relative to said units, as shown by FIGS. 4 and 5, in which the mandrel 28 adopts two different positions.

The triggering of the inkjets of each printing unit 20, 22, 24, 26 is done synchronously with the rotation of the mandrel 28. To that end, a steering unit can receive information on the speed of rotation of the mandrel 28, on the position of the mandrel 28 in translation, and is connected to each printing unit 20, 22, 24, 26 to control the triggering thereof. The steering unit can also receive data representative of the pattern to be printed on the objects, data representative of the diameter of the objects to be printed. The steering unit can control the triggering of the projection of ink from each printing unit 20, 22, 24, 26 as a function of the position of the mandrel 28, and therefore of the object arranged on the mandrel 28, as well as the speed of rotation of the mandrel 28 during printing. The steering of the printing units is known in itself, and is for example described in document EP-1 918 100. It should, however, be noted that this steering is simplified owing to the printing machine according to the present invention. In fact, the motor 30 being directly engaged with the axis of rotation of the mandrel 28, there is no difference between the speed of rotation of the mandrel 28 and that of the drive shaft of the motor 30. It is therefore not necessary to adapt the speed of rotation of the drive shaft of the motor 30 to obtain a constant peripheral speed of the mandrel 28.

The printing machine 1 comprises transfer means 42 for transferring an object 6 to be printed from the transport means 4 to the printing station 16, i.e. from a finger 10 to the mandrel 28. Said transfer means 42 comprise a shaft 44 extending along an axis B-B substantially parallel to axis A-A of the mandrel 28 and translationally mobile along said axis B-B (FIG. 3). The shaft 44 comprises, at its end opposite the frame 2, an arm 46, rotationally mobile around axis B-B and provided, at least at one of its ends, with gripping means 48 able to grasp an object 6. The arm 46 is therefore rotationally mobile in a plane substantially parallel to the vertical circulation plane of the upper branch 14 of the conveyor 8 and can come more or less closer to said plane through the translation of the shaft 44 along axis B-B. The gripping means 48 are for example formed by a clip, the jaws of which assume a shape substantially complementary to the objects 6. Said jaws can move between an open position, in which they can be placed around an object 6, and a closed position, in which the they grip an object 6 without deforming it. The transfer means 42 are therefore able to grasp an object 6 on a finger 10, by rotating the arm 46 so as to place the gripping means 48 opposite to an object 6 supported by a finger 10 and by translating the shaft 44 so as to place the gripping means 48 in the open position around the object 6, then by making the gripping means go to the closed position. The transfer means 42 can also place the gripped object 6 on the mandrel 28, by translating the shaft 44 so as to make the object 6 leave the finger 10 and by rotating the arm 46 so as to place the gripping means 48 supporting the object opposite to the mandrel, then by again translating the shaft 44 so as to bring the object 6 onto the mandrel 28 and by making the gripping means 48 go to the open position so as to release the object 6 maintained by the mandrel 28. It is understood that the transfer means 42 can also take a printed object 6 from the mandrel 28 and place that object 6 on a finger 10, through opposite movements. The shaft 44 is translated by a motor 50 and the arm 46 is rotated by a motor 52 (FIG. 3).

Figure 6:
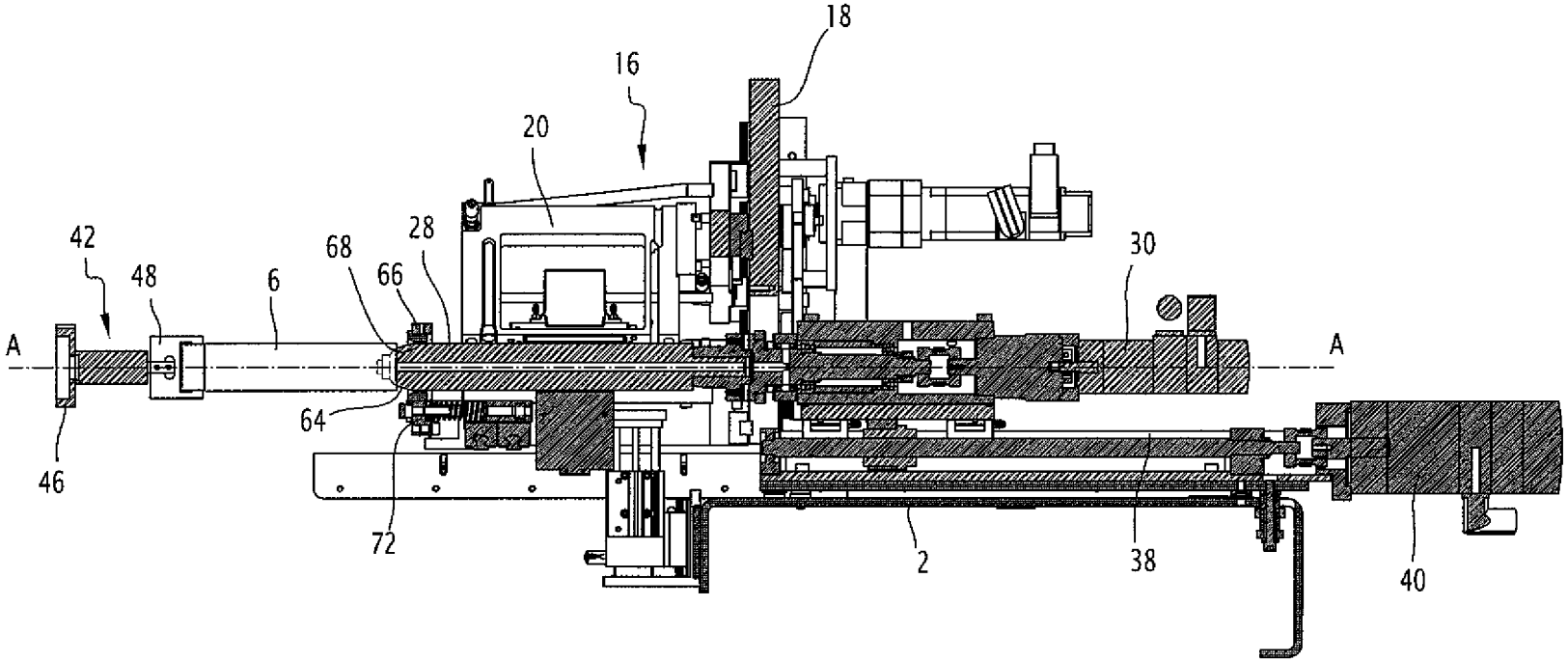
FIGS. 6, 7 and 8 are diagrammatic cross-sectional illustrations of part of a printing station according to one embodiment of the invention during the loading of an object to be printed on a mandrel (FIGS. 6 and 7) and the printing of that mandrel (FIG. 8), the object being shown in top view.
Figure 7:
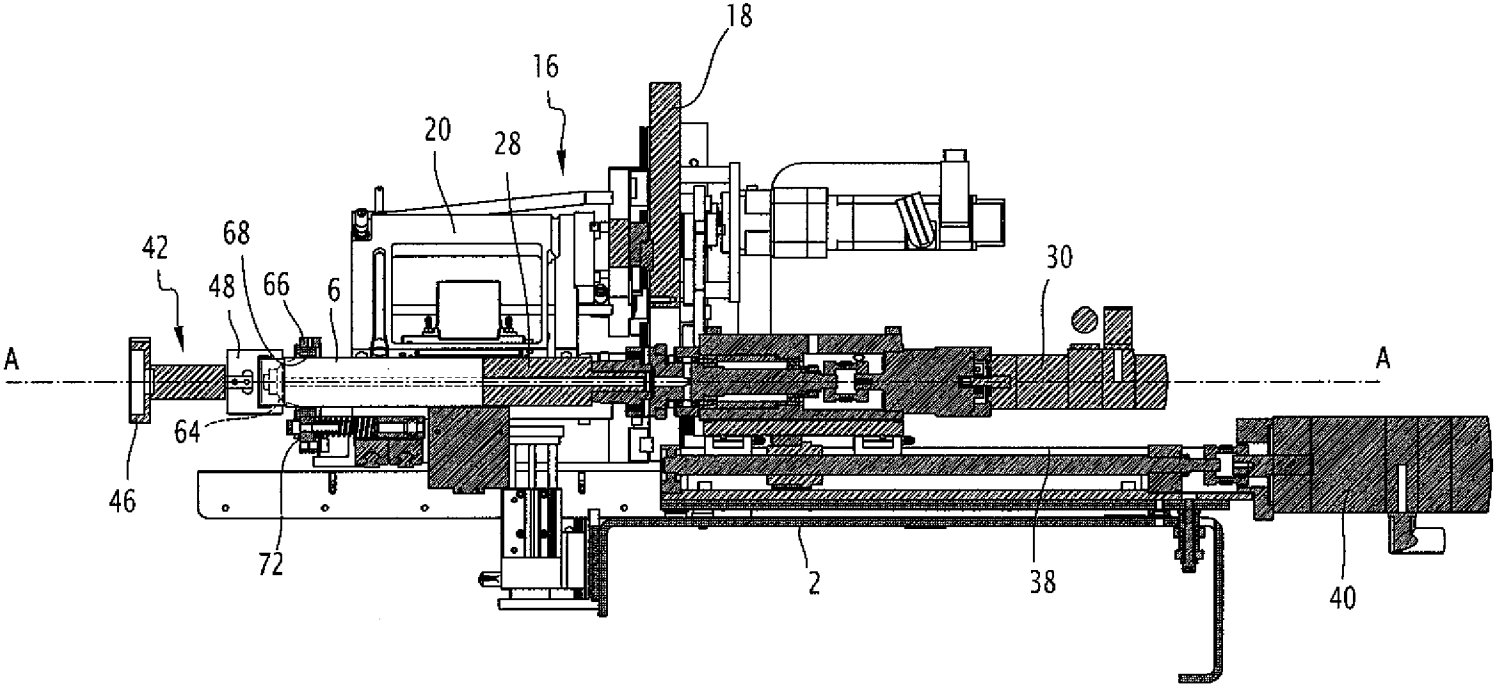
Figure 8:
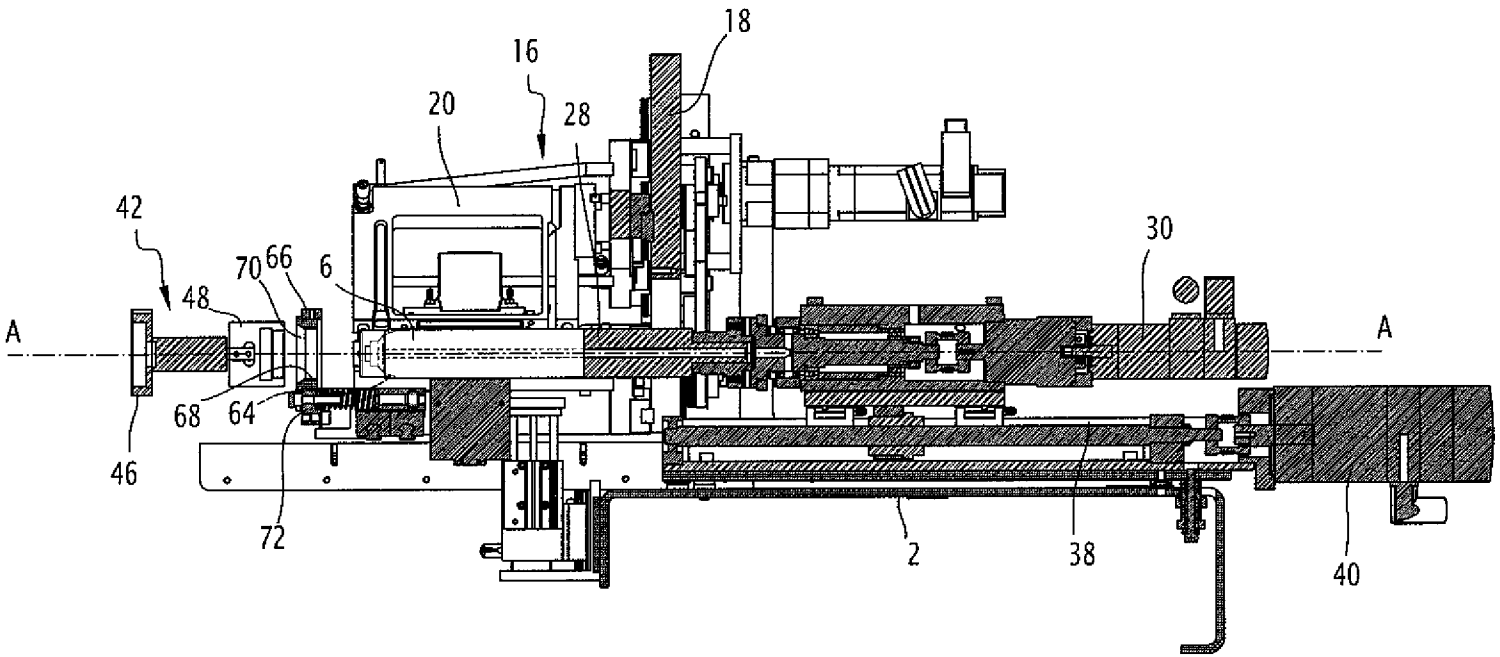

As shown in FIGS. 6, 7 and 8, the free end portion 64 of the mandrel 28, opposite to the transfer means 42, has a truncated cone shape of revolution, the small base of which forms the free end of the mandrel and the large base of which has a diameter equal to the diameter of the rest of the mandrel 28. Such a shape of the free end portion 64 of the mandrel makes it possible to facilitate the loading of an object 6 on the mandrel 28 by forming means for centering the object 6 on the mandrel 28. In fact, the wall of the free end 64 of the mandrel makes it possible to guide the object 6 on the mandrel 28 if the gripping means 48 are not completely centered on the axis A-A of the mandrel 28 during loading of the object 6 on the mandrel 28.

The translation along axis A-A of the mandrel 28 also makes it possible to facilitate loading of an object 6 by making the mandrel 28 mobile between a loading position, shown in FIGS. 6 and 7, and a printing position, shown in FIG. 8. In the loading position, the mandrel 28 is translated toward the gripping means 48, so that its end portion 64 is spaced away from the printing units 20, 22, 24, 26, and in the printing position, the mandrel 28 is returned toward the platen 18 so that the end portion 64 and the printing area of the object 6 extend opposite to the printing units 20, 22, 24, 26. The translational circulation of the transfer means 42, allowing an object 6 to be loaded on the mandrel 28, is thus reduced and the loading is made easier because the end portion 64 of the mandrel 28 is located in a released space when the mandrel 28 is in its loading position, which limits the risk of the object 6 colliding with an element surrounding the mandrel 28 during movement of the transfer means 42.

According to the embodiment shown in the figures, the arm 46 supports a clip at each of its ends and is mounted rotating on the shaft 44 at its center. Thus, the transfer means 42 can grasp an object 6 to be printed on a finger 10 and simultaneously a printed object 6 on the mandrel 28 and deposit the object 6 to be printed on the mandrel 28 and simultaneously the printed object 6 on the finger 10. Thus, through the same operations, a printed object is unloaded from the mandrel 28 and said mandrel is loaded with an object to be printed.

It is possible for certain objects 6 to be deformed or damaged before they are printed, for example during storage. This deformation can cause a local increase in the diameter of the object, for example if the latter has been crushed. The deformation can also cause "crumpling" of the object when it is inserted on the mandrel 28, if the wall of the object 6 bears against the mandrel for example, which also increases the diameter of the object 6. Such an increase in the diameter of the object 6 can irreparably damage the nozzles of the printing units 20, 22, 24, 26 because the object 6 rubs against them when it rotates with the mandrel 28. To avoid such a risk, the printing machine 1 is arranged to prevent a deformed object 6 from being loaded on the mandrel 28.

To that end, the printing machine 1 comprises a calibration ring 66 inserted between the transfer means 42 and the printing units 20, 22, 24, 26 on the axis A-A of rotation of the mandrel 28. The ring 66 is secured to the frame 2 and comprises a central opening 68 with an annular shape complementary to that of the objects to be printed 6 and with axis A-A. In other words, the central opening 68 is centered on axis A-A between the mandrel 28 and the gripping means 48 so that an object 6 to be printed must pass through the central opening 68 when it is loaded on the mandrel 28 by the transfer means 42. The central opening 68 has a diameter larger than that of the mandrel 28, but smaller than the sum of the outer diameter of an object 6 mounted on the mandrel and 1.5 mm, the wall of that object 6. In other words, when the object 6 indeed has a constant outer diameter, play exists substantially equal to twice the thickness of the wall of an object 6 between the edge of the central opening 68 and the object to be printed 6 when the latter passes through the calibration ring 66. The central opening 68 is for example topped by a guide opening 70 having the shape of a truncated cone whereof the small base has a diameter equal to the diameter of the central opening 68 and the large base of which extends toward the transfer means 42. Said guide opening 70 makes it possible to center an object to be printed 6 on the central opening 68, the edge of the guide opening 70 allowing the object 6 toward the central opening 68 if the gripping means 48 are not completely centered on axis A-A.

The position of the calibration ring 66 relative to the frame 2 is such that the central opening 68 extends around the end portion 64 of the mandrel 28 when the latter is in the loading position, as shown in FIGS. 6 and 7. The ring 66 therefore extends upstream of the printing units 20, 22, 24, 26 relative to the direction of loading of an object 6 on the mandrel 28. The object 6 is already engaged on the mandrel 28 and centered by its end portion 64 when it passes through the central opening 68 of the calibration ring 66, which improves the guiding of the object 6 toward that opening 68 and facilitates its passage through the opening 68 despite the small play between the object 6 and the edge of the opening 68.

It will be understood that if the object to be printed 6 is deformed and has a diameter larger than the diameter it should have, it cannot pass through the central opening 68 of the calibration ring 66. In fact, in that case, the object 6 is stopped by the edge of the guide opening 70 or by that of the central opening 68. The ring 66 is mounted on the frame 2 via a slide 72, which makes it translatable along an axis parallel to axis A-A relative to the frame 2. Thus, if a deformed object 6 collides with the ring 66, the latter is translated toward the frame and actuates a contactor arranged to stop the motor 50 actuating the translation of the transfer means 42. Thus, the loading of a deformed object 6 is immediately stopped and that object 6 cannot damage the nozzles of the printing units 20, 22, 24, 26 since the ring 66 extends upstream thereof relative to the loading direction of the objects 6 and the diameter of its central opening 68 is smaller than the sum of the diameter of the object 6 and 1.5 mm, knowing that the distance between the lower edge of a nozzle and the object 6 is about 0.8 mm, i.e. there is a space of at least 0.1 mm between an object 6 having passed through the ring 66 and the nozzles of the printing units 20, 22, 24, 26. The ring 66 therefore makes it possible to ensure that only objects 6 having the required shape and diameter will be printed by the printing station 16.

The objects 6 being placed freely on the fingers 10, they should be positioned around the fingers 10 relative to the gripping means 48 of the transfer device 42. To that end, the printing machine 1 comprises means 54 for blocking the position of an object 6 around a receiving finger 10 arranged opposite to the transfer means 44. These blocking means 54 are formed by a blocking element 56 provided with at least one blocking surface 58 and mounted translationally mobile in the vertical plane relative to the frame 2 between a blocking position and a retracted position. In the blocking position, the blocking surface 58 is pressed against an object 6 supported by a finger 10 opposite to the transfer means 44 so as to immobilize said object 6 around the finger 10 and in the retracted position, the blocking element 58 is remote from the conveyor 8. It should be noted that in the blocking position, the object 6 is no longer in contact with the finger 10, the object 6 being lifted from that finger by the blocking surface 58.

The blocking surface 58 is arranged not to deteriorate the printing area of the object 6, which could create flaws in the printing of the object. To that end, the blocking surface 58 for example has a shape substantially complementary to a portion of the object 6 to be printed and is coated with a fabric or another protective material arranged so as not to damage the printing area of the object. According to another embodiment, the blocking element 56 comprises one or more blocking surfaces arranged to be pressed against the object 6 outside the area to be printed, for example above and/or below said area to be printed.

In order to ensure blocking of the position of the object 6 around the finger 10, the blocking means 54 also comprise suction means for the object 6 supported by the receiving finger, said suction means being arranged to immobilize said object 6 on the blocking surface 58 in the blocking position.

The blocking means 54 are placed in the retracted position after an object 6 to be printed is taken on the finger 10 in order not to come into contact with a printed object 6 that is placed on said finger 10 and thereby not damage the printed area of said object 6. In fact, as previously described, a printed object 6 is placed on the receiving finger 10 from which an object to be printed was taken during the transfer of that object to be printed from the finger 10 to the mandrel 28.

A pre-treatment station 60 for the surface of the objects 6 to be printed is provided upstream of the printing station 16, between the loading station and the printing station 16 opposite to the fingers 10. That pre-treatment station 60 is arranged to perform a treatment of the area to be printed of the objects 6 before they are printed. This treatment has the aim of allowing better adhesion of the ink on the area to be printed.

Moreover, a drying station 62 for the surface of the printed objects 6 is provided downstream of the printing station 16, between the printing station 16 and the unloading station opposite to the fingers 10. This station is for example formed by core polymerization means of the printing so as to definitively freeze the ink on the surface of the printed objects.

The printing machine described above comprises a single printing station 16. To increase the printing rhythm, several printing stations can be added. Thus, according to one embodiment that is not shown, the printing machine comprises two printing stations 16 arranged next to one another and according to the embodiment shown in FIG. 6, the printing machine 1 comprises four printing stations 16 arranged next to one another. Each printing station 16 comprises its own unique mandrel 28 on which the printing units of said station print only the objects supported by said mandrel 28. Each printing station 16 also has corresponding transfer means 42, blocking means 54 and a drying station 62. A pre-treatment station 60 for the surface is adapted to operate with two printing stations 16. Thus, according to the embodiment shown in FIG. 6, the printing machine 1 comprises two pre-treatment stations 60 for four printing stations 16.

The operation of the printing machine 1 and the method for printing the objects will now be described.

The objects to be printed 6 are first loaded on the conveyor 8 at the loading station, the objects being arranged one after another on adjacent receiving fingers 10. The objects 6 then circulate on the upper branch 14 and advance in direction F and pass in front of the pre-treatment station 60, where they undergo a surface treatment for their subsequent printing.

According to the embodiment in which the printing machine comprises a single printing station, when an object 6 to be printed arrives opposite to the transfer means 42, the printing machine stops. The blocking means 54 go into the blocking position and the mandrel 28 goes into the loading position. The transfer means 42 take the object 6 from the conveyor and place it on the mandrel 28 while passing through the calibration ring 66. The mandrel 28 then returns to its printing position. If a printed object was arranged on the mandrel 28, that object is taken at the same time and placed on the finger that has just been freed up. The blocking means 54 return to their retracted position during this transfer of the objects in order not to come into contact with the printed object. The conveyor 8 starts to circulate again so as to bring the next finger opposite to the transfer means 42 and restart the transfer described above.

If a deformed object is taken from the conveyor, it collides with the ring 66 when the transfer means 42 place it on the mandrel 28, which drives the cutoff of the movement of the transfer means. An operator can then remove the defective object 6 and relaunch the printing machine, the transfer means taking the next object on the conveyor.

The object 6 placed on the mandrel 28 is printed by exposing it to the ink jets from the different printing units 20, 22, 24, 26. The triggering of the printing units is done synchronously with the rotation of the mandrel 28, in a known manner using the steering unit as a function of the speed of rotation of the mandrel 28, the position of the object on the mandrel, the pattern to be printed and the diameter of the object to be printed.

If the area to be printed is larger than the height of the printing units, the mandrel 28 is translated during the printing process so that the entire printing area is printed. To that end, the printing process comprises the rotation of the mandrel 28 in order to print a first printing area opposite to the printing units (FIG. 4), then the stopping of the rotation, the translation of the mandrel 28 in order to place a second printing area opposite to the printing units (FIG. 5), then the resumption of the rotation of the mandrel 28 in order to print the second printing area.

As a complement to the printing of the four colors forming the four-color process, the object may undergo varnishing and/or printing of a white background (for example for colored objects) and/or partial drying if the corresponding units are active on the printing station. It should be noted that the printing rhythm is very high, due to the number of printing units, the simplicity of adjusting the single-mandrel printing station 16 and the fact that the printing is done very precisely because axis A-A of the mandrel 18 is stationary and the position of the object 6 therefore does not vary and is known at all times. It will in particular be noted that, since the axis of the mandrel is stationary, it is easy to add a printing unit around the mandrel 28, while distributing the printing units over a range larger than 180°, to add other possibilities such as varnishing and/or printing a white background and/or to increase the printing rhythm.

When the printing machine 1 comprises two printing stations 16, the machine advances by two pitches, i.e. twice the distance d separating two fingers, before stopping so that an object is situated opposite to the transfer means 42 of the two printing stations 16. The machine 1 stops and the transfer of the objects is done. During the printing of said objects, the printing machine advances again by two pitches, in order to place two new objects opposite to the transfer means 42. This is called two-pitch indexing of the conveyor 8. When the printing machine 1 comprises two printing stations 16, the pitch, i.e. the distance d, is for example substantially equal to 300 mm (6 inches).

Figure 9:
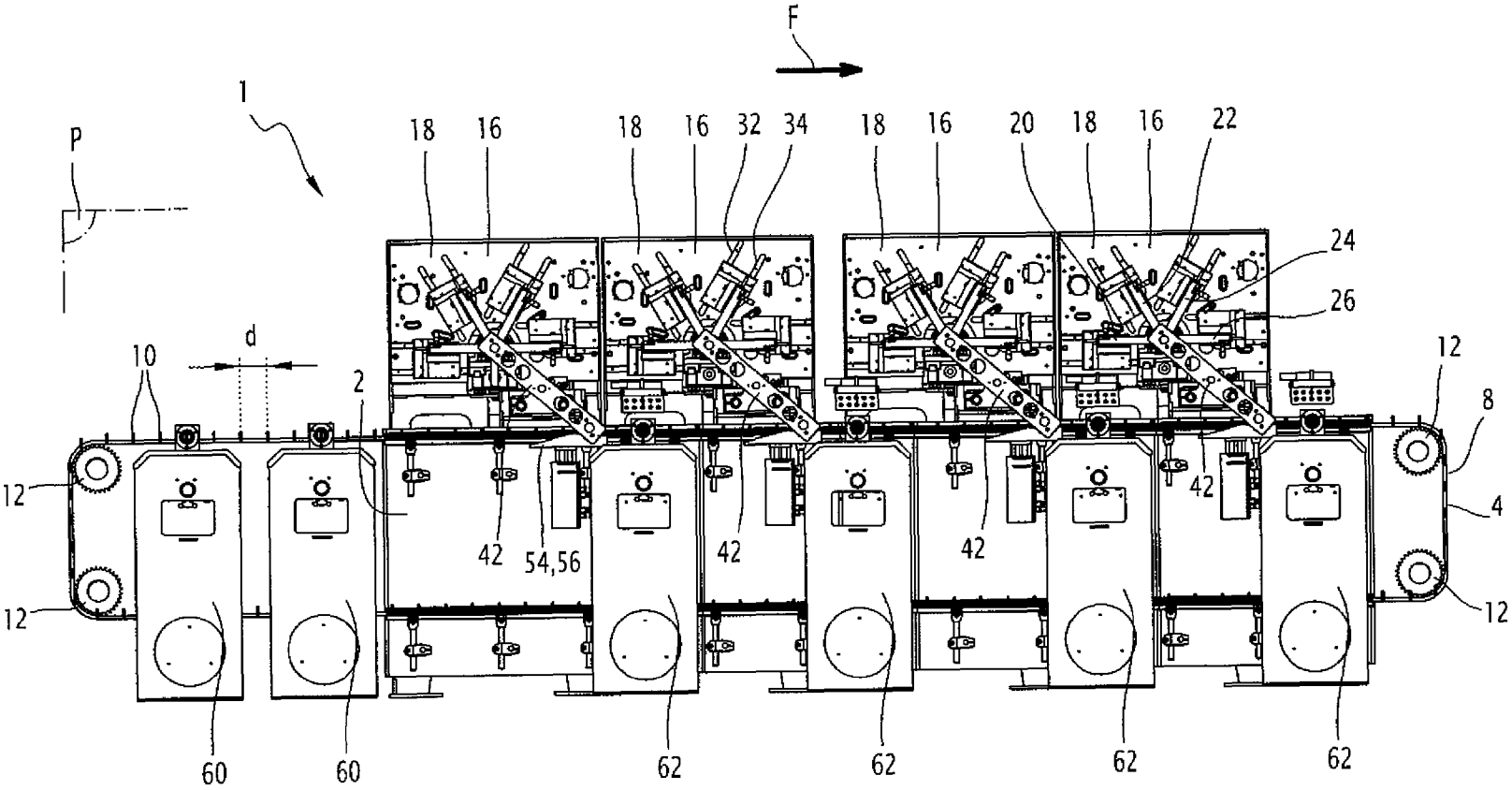
FIG. 9 is a diagrammatic front illustration of a printing machine comprising four printing stations.

When the printing machine 1 comprises four printing stations 16, as shown in FIG. 9, the printing machine 1 is indexed twice by two pitches during the printing cycle of an object, each printing station 16 printing one out of four objects passing opposite to its transfer means 42. When the printing machine 1 comprises four printing stations 16, the pitch is for example substantially equal to 150 mm (3 inches). For a machine 1 with four printing stations, during a printing cycle, the stations print four objects at the same time. The indexing is still by two pitches and there are two indexes (i.e. two stops of the conveyor 8) per printing cycle, so that the two first printing stations relative to direction F print the objects supported by every other finger (even fingers), i.e. an object situated between two even fingers is left on its finger (odd finger) and the last two printing stations print the objects supported by the odd fingers. One thus obtains an optimized operation of the machine with four printing stations.

The printing rhythm can thus easily be increased by simply adding printing stations along the conveyor 8, the architecture of the printing machine being simple enough not to unduly complicate the assembly of said stations. Such a rhythm cannot be increased as simply in the prior art due to the mode of transportation of the objects to be printed on a plurality of mandrels mounted on a rotating plate.

At the outlet of the printing station, the printed objects pass opposite to the drying station 62, where said objects undergoes core polymerization to definitively freeze the printing.

The objects are then unloaded at the unloading station.

The machine described above therefore makes it possible to obtain very precise printing with a high resolution without requiring complex adjustment of the printing station 16. In fact, after an initial calibration to trigger ink jets synchronized with the rotation of the mandrel 28, it is no longer necessary to perform other adjustments of the printing station during printing, as long as the objects to be printed are identical to one another. In addition, the printing rhythm can easily be increased.

Furthermore, the machine makes it possible to protect the printing units from a defective object that may damage them by rubbing against the inkjet nozzles owing to the calibration ring.

What is claimed is:

1. A printing machine for printing objects substantially having shapes of revolution, the machine comprising:

a transporter for transporting objects to be printed between at least one loading station for loading objects on the transporter and an unloading station for unloading the objects from the transporter;

at least one printing station arranged between the loading station and the unloading station, the printing station including at least four printing units arranged to project ink on the objects to be printed so as to print the objects, each printing unit projecting ink of a different color so as to make up a four-color process;

a transfer device for transferring an object to be printed from the transporter to a single mandrel of the printing station and from the single mandrel of the printing station to the transporter; and a calibration ring comprising a central opening coaxial to the axis of rotation of the mandrel, the calibration ring being arranged between the transfer device and the printing unit so that the object to be printed passes through the central opening before being printed by the printing station, the printing station including the single mandrel for maintaining one of the objects to be printed, the mandrel being rotatably movable around an axis so that the printing units project ink onto the object maintained by the mandrel, the printing station being arranged to print only the objects maintained by the mandrel, wherein the axis of rotation of the mandrel is always stationary relative to the at least four printing units of the printing station, the printing units of the printing station being arranged on an arc of circle centered on the axis of rotation of the corresponding mandrel, wherein the object to be printed must pass through the central opening when the object is loaded on the mandrel by the transfer device.

2. The printing machine as recited in claim 1 wherein each printing unit can be moved in a substantially radial direction relative to the axis of rotation of the mandrel so as to make it possible to move the printing unit away from or closer to the axis of rotation as a function of a diameter of the object to be printed.

3. The printing machine as recited in claim 1 wherein the diameter of the central opening is larger than the diameter of the mandrel and arranged so that there is a space of at least 0.1 mm between the object passed through the central opening of the ring and nozzles of the printing unit.

4. The printing machine as recited in claim 1 wherein the ring can be moved and is arranged to actuate a contactor, arranged to stop the transfer device when it is actuated, if the object to be printed having a diameter larger than the diameter of the central opening, taken by the transfer device, moves the ring.

5. The printing machine as recited in claim 1 wherein the mandrel is translationally mobile along the axis between a printing position, in which a free end portion of the mandrel is located opposite to the printing units, and a loading position, in which the central opening of the ring surrounds the free end portion of the mandrel.

6. The printing machine as recited in claim 1 wherein the printing station comprises at least one additional printing unit in addition to the four printing units, the four units and the additional unit being distributed on the same arc of circle centered on the axis of rotation of the mandrel.

7. The printing machine as recited in claim 1 wherein the printing station also comprises a surface drying unit for drying the ink projected on the object to be printed, the unit being arranged on the same arc of circle centered on the axis of rotation of the corresponding mandrel as the printing unit.

8. The printing machine as recited in claim 1 wherein the mandrel is translationally mobile along the axis so as to make it possible to expose several areas of the maintained object to the inkjet from the printing unit.

9. The printing machine as recited in claim 1 wherein the transfer device comprises at least one mobile arm supporting a gripper for gripping the object to be printed, the arm and the gripper being arranged to take the object on the transporter and to deposit the object on the mandrel and to take the object after printing from the mandrel and deposit the printed object on the transporter.

10. The printing machine as recited in claim 1 wherein the transporter comprises an endless conveyor, the conveyor comprising a plurality of fingers for receiving the object to be printed.

11. The printing machine as recited in claim 10 further comprising a block for blocking the position of the object around a receiving finger opposite to the transfer device, the block being mobile between a blocking position, in which the block keeps the object immobile around a receiving finger opposite to the transfer device, and a retracted position, in which the block is moved away from the conveyor.

12. The printing machine as recited in claim 11 wherein the block comprises a translationally mobile blocking element, the blocking element comprising at least one blocking surface, the block being arranged so that the blocking surface is in contact with the object supported by the receiving finger in the blocking position and so that the blocking surface is moved away from the conveyor in the retracted position, the block also comprising a suction for suctioning the object supported by the receiving finger, the suction being arranged to immobilize the object on the blocking surface in the blocking position.

13. The printing machine as recited in claim 1 further comprising a pretreatment station for pretreating the surface of the objects to be printed, the pretreatment station being arranged between the loading station and the printing station and being arranged to treat the surface of the objects to be printed on the transporter.

14. The printing machine as recited in claim 1 further comprising at least one drying station for drying the surface of the printed objects, the drying station being arranged between the printing station and the unloading station and being arranged to dry the surface of the printed objects.

15. The printing machine as recited in claim 1 wherein the at least one printing station comprises at least two printing stations each comprising a corresponding single mandrel, the printing stations being arranged each to print only the objects maintained by their corresponding mandrel.

16. The printing machine as recited in claim 15 wherein the transporter includes an endless conveyor arranged to stop when a finger supporting the object to be printed is located opposite to corresponding transfer devices to each printing station.

17. A printing machine for printing objects substantially having shapes of revolution, the machine comprising:

a transporter for transporting objects to be printed between at least one loading station for loading objects on the transporter and an unloading station for unloading the objects from the transporter;

at least one printing station arranged between the loading station and the unloading station, the printing station including at least four printing units arranged to project ink on the objects to be printed so as to print the objects, each printing unit projecting ink of a different color so as to make up a four-color process;

a transfer device for transferring an object to be printed from the transporter to the printing station and from the printing station to the transporter;

the printing station including a single mandrel corresponding to maintenance of one of the objects to be printed, the mandrel being rotatably movable around an axis so that the printing units project ink onto the object maintained by the mandrel, the printing station being arranged to print only the objects maintained by the mandrel, wherein the axis of rotation of the mandrel is stationary relative to the printing station, the printing units of the printing station being arranged on an arc of circle centered on the axis of rotation of the corresponding mandrel, wherein the printing machine comprises a calibration ring comprising a central opening coaxial to the axis of rotation of the mandrel, the calibration ring being arranged between the transfer device and the printing unit so that the object to be printed passes through the central opening before being printed by the printing station, wherein the mandrel is translationally mobile along the axis between a printing position, in which a free end portion of the mandrel is located opposite to the printing units, and a loading position, in which the central opening of the ring surrounds the free end portion of the mandrel.

18. A printing machine for printing objects substantially having shapes of revolution, the machine comprising:

a transporter for transporting objects to be printed between at least one loading station for loading objects on the transporter and an unloading station for unloading the objects from the transporter, the transporter including an endless conveyor;

at least one printing station arranged between the loading station and the unloading station, the printing station including at least four printing units arranged to project ink on the objects to be printed so as to print the objects, each printing unit projecting ink of a different color so as to make up a four-color process;

a transfer device for transferring an object to be printed from the transporter to the printing station and from the printing station to the transporter, the printing station including a single mandrel corresponding to maintenance of one of the objects to be printed, the mandrel being rotatably movable around an axis so that the printing units project ink onto the object maintained by the mandrel, the printing station being arranged to print only the objects maintained by the mandrel, the conveyor comprising a plurality of fingers for receiving the object to be printed; and a block for blocking the position of the object around a receiving finger opposite to the transfer device, the block being mobile between a blocking position, in which the block keeps the object immobile around a receiving finger opposite to the transfer device, and a retracted position, in which the block is moved away from the conveyor.

19. The printing machine as recited in claim 18 wherein the block comprises a translationally mobile blocking element, the blocking element comprising at least one blocking surface, the block being arranged so that the blocking surface is in contact with the object supported by the receiving finger in the blocking position and so that the blocking surface is moved away from the conveyor in the retracted position, the block also comprising a suction for suctioning the object supported by the receiving finger, the suction being arranged to immobilize the object on the blocking surface in the blocking position.

* * * * *